US007490726B2

(12) United States Patent
Virvo

(10) Patent No.: US 7,490,726 B2
(45) Date of Patent: Feb. 17, 2009

(54) SOFT TOY HOLDER

(76) Inventor: Alexander Virvo, 33 Glen Terrace, Stamford, CT (US) 06906

( * ) Notice: Subject to any disclaimer, the term of this patent is extended or adjusted under 35 U.S.C. 154(b) by 0 days.

(21) Appl. No.: 10/229,801

(22) Filed: Aug. 28, 2002

(65) Prior Publication Data

US 2003/0042214 A1 Mar. 6, 2003

Related U.S. Application Data

(60) Provisional application No. 60/317,656, filed on Sep. 6, 2001.

(51) Int. Cl.
*B65D 81/05* (2006.01)

(52) U.S. Cl. ..... 211/70.1; 211/71.01; 211/72; 211/73; 206/485

(58) Field of Classification Search ..... 211/13.1, 211/73, 85.4, 72, 126.16, 135, 195, 70.1, 211/71.01; 446/73, 1; 206/763, 490, 486, 206/521.6, 521.7, 779, 764, 315.1, 315.9, 206/476, 485, 775; 40/124.06, 124.14, 539; 220/62, 62.1; 248/174, 150, 152
See application file for complete search history.

(56) References Cited

U.S. PATENT DOCUMENTS 1,171,083 A * 2/1916 Bailey ..... 206/521.6
1,981,731 A * 11/1934 Holy ..... 206/419
D95,956 S * 6/1935 Holy ..... D9/750
2,102,982 A * 12/1937 Taylor ..... 211/1.53
2,307,992 A * 1/1943 Calhoun et al. ..... 206/733
2,307,993 A * 1/1943 Calhoun et al. ..... 211/26
2,426,899 A * 9/1947 Pantalone ..... 493/162
2,511,542 A * 6/1950 Rau ..... 206/553
2,688,408 A * 9/1954 Binggely ..... 211/13.1
3,002,722 A * 10/1961 Cote ..... 248/174
3,201,023 A * 8/1965 Hailey et al. ..... 206/521.7
3,382,986 A * 5/1968 Pfeiffer ..... 211/70.1
3,462,020 A * 8/1969 Hall ..... 211/26.2
3,556,527 A * 1/1971 Margolis et al. ..... 273/115
3,754,642 A * 8/1973 Stidolph ..... 206/752
3,815,613 A * 6/1974 Reavis ..... 131/260
4,033,489 A * 7/1977 Fowler ..... 294/159
4,435,915 A * 3/1984 Zaruba et al. ..... 446/75
4,462,178 A * 7/1984 Freeman ..... 40/539
4,651,873 A * 3/1987 Stolcenberg et al. ..... 206/142
5,186,319 A 2/1993 Ting (Continued)

OTHER PUBLICATIONS

Cookie box: http://web.archive.org/web/20021019184513/http://www.annasthins.ca/.*

(Continued)

*Primary Examiner*—Katherine W Mitchell
*Assistant Examiner*—Colleen M Quinn
(74) *Attorney, Agent, or Firm*—Mark Nowotarski

(57) ABSTRACT

A holder for soft toys includes a sheet of material that contains at least one amoeba shaped opening. The amoeba shaped opening is adapted to hold and align the soft toy when the soft toy is inserted into the opening. The soft toy is held in position irrespective of the orientation of the opening with respect to gravity.

3 Claims, 17 Drawing Sheets

U.S. PATENT DOCUMENTS

| | | | | | |
|---|---|---|---|---|---|
| D337,137 | S | * | 7/1993 | Musca | D21/621 |
| 5,505,309 | A | * | 4/1996 | Taravella et al. | 206/485 |
| 5,593,041 | A | | 1/1997 | Capozzi | |
| 5,713,470 | A | * | 2/1998 | Presta | 206/526 |
| 5,813,545 | A | | 9/1998 | Greenberg | |
| D402,826 | S | | 12/1998 | Barkley | |
| 5,881,977 | A | * | 3/1999 | Danneberg | 248/150 |
| 5,884,767 | A | * | 3/1999 | Peng | 206/485 |
| 5,919,074 | A | | 7/1999 | Honda | |
| 6,220,443 | B1 | * | 4/2001 | Damaskos | 206/763 |
| 6,269,961 | B1 | * | 8/2001 | Porcelli | 211/70.7 |
| 6,460,703 | B1 | * | 10/2002 | Thompson et al. | 206/779 |
| 6,591,994 | B1 | * | 7/2003 | Bearss | 211/85.7 |
| 6,966,446 | B1 | * | 11/2005 | Wise et al. | 211/113 |

OTHER PUBLICATIONS

"Soft Toy Shelf" www.pettingzooplush.com/pos_display_program.htm.

"Catalogue: Metal Accessories", Medical Furniture www.medicalfurniture.co.uk/accessories.asp?list=11, Item: Soft Toy Holder.

Amoeba Dish: www.prezzybox.com/products/index.aspx?pid=1565, archived Nov. 3, 2004.

Amoeba Chess: www.chessvariants.org/38.dir/amoeba.html, created Nov. 30, 1997.

Amoeba Wine Rack: www.oporb.com/access/2296.htm, copyright 2003.

*The American Heritage Dictionary of the English Language*, 1973, p. 1184, American Heritage Publishing Company, NY, NY.

* cited by examiner

SOFT TOY HOLDER

CROSS-REFERENCE TO RELATED APPLICATION

This application claims the benefit of the filing date of U.S. provisional application entitled "Soft Toy Holder", Ser. No. 60/317,656, filed Sep. 6, 2001.

BACKGROUND OF THE INVENTION

1. Technical Field

The present invention relates generally to the field of item holders and more particularly to holders for soft toys.

2. Background Art

A known means of displaying soft toys, such as teddy bears, is to place them on a shelf. This means is practiced for display for retail sale, such as in a toy store, and for personal display, such as in a child's bedroom. The Petting Zoo of Glen Burnie, Md. offers shelf display unit 100 for display of multiple soft toys 102 (FIG. 1). Shelf display units are often inadequate due to the ease with which soft toys can be knocked off of the shelf. They are further inadequate due to the tendency of toys to flop down into a lying position rather than staying in a sitting position. It is difficult to take inventory of soft toys when they are displayed on a shelf since it is not immediately obvious how many items are present, how many items should be present and how many items have been removed.

Another known means for displaying soft toys is to place them on a two-prong hook. Medicalfurniture Company of the United Kingdom offers two-prong hook 104 for display and storage of soft toy 106 (FIG. 2). The two-prong hook is sold to hospitals to provide a means for a child to store, display and retrieve a personal soft toy close to their bed. In order to use a two-prong hook, a child must accurately convey the soft toy in horizontal direction 108. This may be beyond the ability of a child, particularly if they are very young or ill. Furthermore, the two-prong hook will not adequately hold a soft toy, such as a sponge ball, that does not have any appendages. The two-prong hook can pose a safety hazard if the child were to push their hand or other part of their body into one or more of the prongs while attempting to place a soft toy on it.

Another known means for displaying soft toys is a horizontal loop. U.S. Pat. No. Des. 402,826, "Plush Toy Display Stand", to Barkley, discloses a plush toy holder which comprises a plurality of loops attached to a frame. Plush toys are generally also soft toys as used herein. This means requires an accurate up and down movement to insert or remove a soft toy. It presents a "bound" appearance to the soft toys due to the bands that appear to shackle them. This may be objectionable to some people. It also relies on gravity to hold the toy.

Another known means for displaying soft toys is a vertical aperture. U.S. Pat. No. 5,813,545, "Apparatus and Method for Display of Stuffed Animals", to Greenburg, discloses a stuffed animal holder which comprises a plurality of vertical loops in a tree frame structure. A stuffed animal is generally a soft toy as used herein. This means requires the stuffed animal to have appendages. This means also does not allow the entire toy to be viewed at once.

Another known means for displaying soft toys is the combination of a vertical opening and a shelf U.S. Pat. No. 4,435,915, "Hanging Doll House Structure", to Zaruba et al, discloses a doll holder which comprises a plurality of vertical openings that are used in combination with adjacent shelves. This means relies on gravity to support the dolls. It also does not allow the entire doll to be viewed at once. Dolls are not necessarily soft toys as used herein. Hard plastic dolls, such as Barbie™ dolls are not soft toys. Stuffed dolls, such as Raggedy Ann dolls are soft toys.

Another known means for displaying soft toys is a concave aperture defined by an edge and a plurality of slits extending away from the edge. U.S. Pat. No. 5,186,319, "Transport and Display Case for a Figurine" to Ting, discloses a means for displaying an animal head figurine which comprises a concave aperture defined by an edge and a plurality of slits extending away from the edge. This means relies on gravity to properly orient the head relative to the opening. This means does not allow the entire figure to be viewed at once.

A known means for holding displaying hard objects is to provide a chamber comprising a sheet of material with an aperture. U.S. Pat. No. 6,220,443 B1, "Package" to Damaskos discloses a means for holding and displaying axially symmetric hard objects such as medicine bottles where a chamber comprising a sheet of material with an aperture is provided. The aperture is adapted to retain the hard objects within the chamber. The aperture may have an amoeba shape. This reference neither teaches nor suggests the use of a sheet of material with an amoeba shaped opening adapted to hold a soft toy.

There are no devices or methods, prior to the present invention, that disclose the use of a sheet of material comprising an amoeba shaped opening adapted to hold or display a soft toy. The sheet of material is able to hold soft toys irrespective of the orientation of the opening with respect to gravity, requires only a minimum of dexterity and strength to insert or remove a soft toy therefrom, can display soft toys in an orderly fashion with an obvious indication of the absence of a soft toy, and can hold soft toys whether or not they have appendages. The prior art soft toy holders fail to offer the unique advantages contemplated by the present invention.

SUMMARY OF THE INVENTION

Against the foregoing background, it is a primary object of the present invention to provide a soft toy holder comprising a sheet of material wherein there is an opening in the sheet wherein the opening has an amoeba shape and wherein the amoeba shape is adapted to hold a soft toy.

It is another object of the present invention to provide a soft toy holder that is suitable for retail display of a soft toy.

It is another object of the present invention to provide a soft toy holder that is suitable for personal display of a soft toy.

It is another object of the present invention to provide such a soft toy holder that is inexpensive to manufacture.

It is another object of this invention to provide a soft toy holder to display soft toys in an orderly manner.

It is another object of this invention to provide a soft toy holder which can hold a soft toy near a bed ridden child where said child can retrieve said toy merely by pulling it from the holder and can replace the toy by pushing it into the holder.

It is a further object of this invention to provide a soft toy holder that does not provide an undue safety hazard.

It is a further object of this invention to provide a soft toy holder than can hold a toy equally well in all orientations with respect to gravity.

It is a further object of this invention to provide a soft toy holder than can hold soft toys that have a large variation in size.

It is a further object of this invention to provide a soft toy holder that has particular appeal as a retail package.

It is a further object of this invention to provide a soft toy holder than serve as a retail package for the combination of a soft toy and other objects.

It is a further object of this invention to provide a soft toy holder that can serve as a greeting card.

To accomplish the foregoing objects and advantages, the present invention, in brief summary, comprises a sheet of material wherein there is at least one opening in said sheet of material that has an amoeba shape. The term "amoeba shape" as used herein means that the perimeter of the opening comprises a convex portion and a concave portion. The term "soft toy" as used herein means a toy that comprises a portion which can be squeezed, squished or otherwise substantially deformed by a child. The child may be an infant. Soft toys include but are not limited to stuffed animals or plush toys, such as teddy bears and the like, bean bag toys, such as TY Beanie Babies™ and the like, and sponge toys, such as sponge balls and the like.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION

Figure 1:
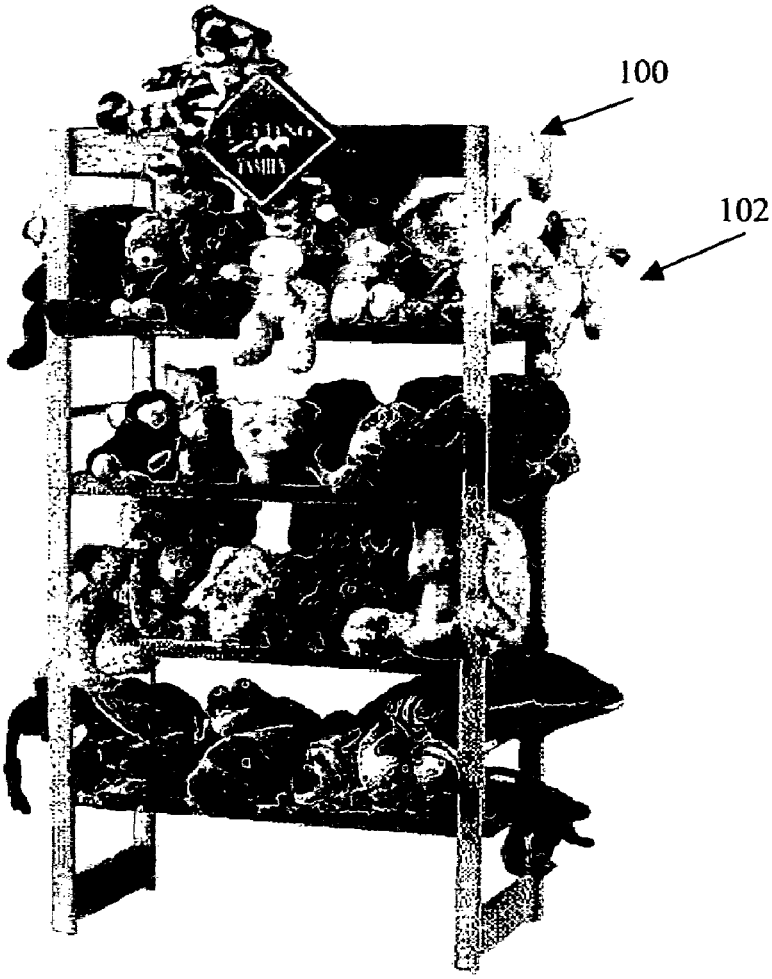
Prior Art Fig 1
FIG. 1 is a perspective view of the prior art that uses a plurality of shelves to display soft toys for retail sale.
Figure 2:
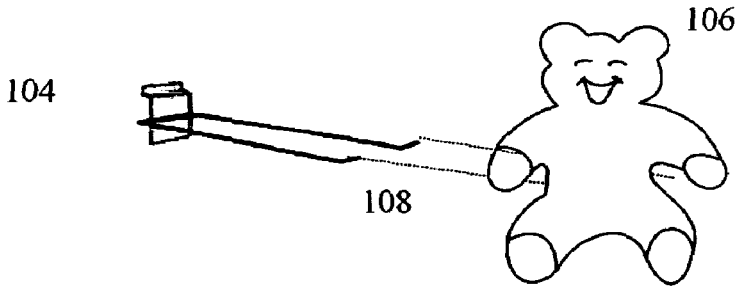
Prior Art Fig 2
FIG. 2 is a perspective view of the prior art that uses a two-prong hook for holding a soft toy.
Figure 3:
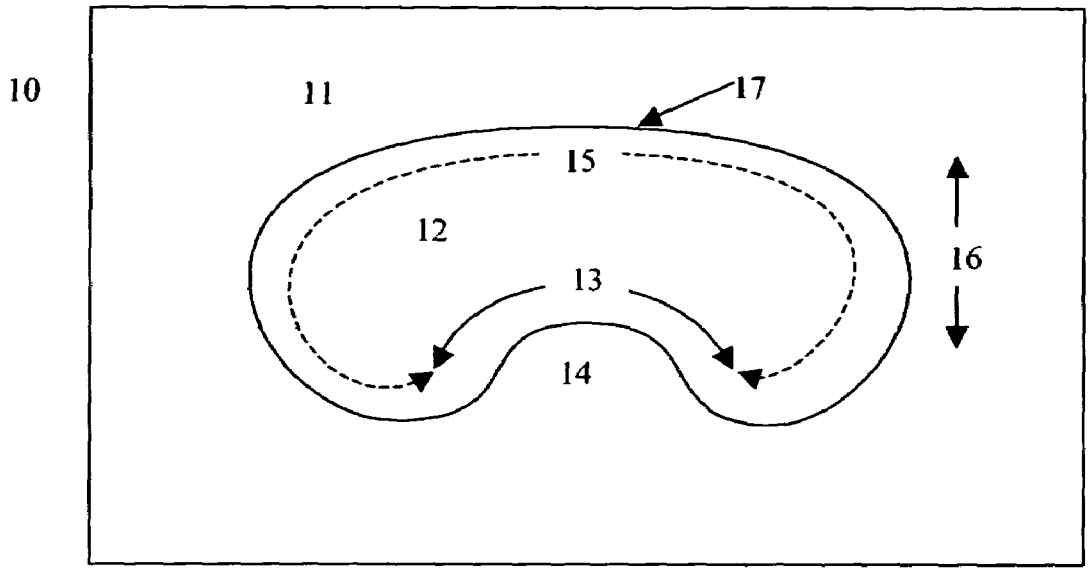
FIG. 3 is a plan view the preferred embodiment of the present invention comprising a sheet of material with an amoeba shaped opening.

Referring to FIG. 3, the soft toy holder of the preferred embodiment of the present invention is provided and is referred to generally by reference numeral 10. Soft toy holder 10 comprises a sheet of material 11 that contains an amoeba shaped opening 12. The edge of the opening comprises concave portion indicated by dashed curved arrow 15 and convex portion indicated by solid curved arrow 13. The convex portion defines tab 14 that protrudes into the opening. The concave portion defines a scoop 17 that retreats away from the opening. The shape of the opening is about the same as a cross section of the soft toy to be held. The tabs may correspond to the armpits, crotch or other indentations in the soft toy. The scoops may correspond to the appendages such as arms, legs and head of the soft toy. The tabs and scoops cooperate to help align the soft toy with a particular orientation as it is placed in the opening. They also cooperate to establish a preferred depth of penetration of the soft toy through the opening.

Preferably at least some dimension 16 of the opening is smaller than the corresponding dimension of the soft toy to be held such that the toy is snugly held in the opening. The dimension of the cross section should not be so small as to require undue force to insert or remove the soft toy or to damage the soft toy or the holder.

The sheet is preferably sufficiently stiff to hold a soft toy under its own weight without undue deformation of the sheet or damage to the soft toy. A sheet of cardboard such as what a cereal box might be made out of has sufficient stiffness for a medium sized teddy bear.

The sheet of material preferably has enough flex so that the holder does not bind or tear the soft toy when said toy is inserted. A sheet of cardboard would be suitable for a medium sized soft toy, such as a teddy bear.

The sheet of material may be very stiff since soft toys are very deformable. Wood, plastic, metal and the like are also suitable materials for the soft toy holder.

The soft toy holder may comprise a wire formed into an amoeba shape.

Figure 4:
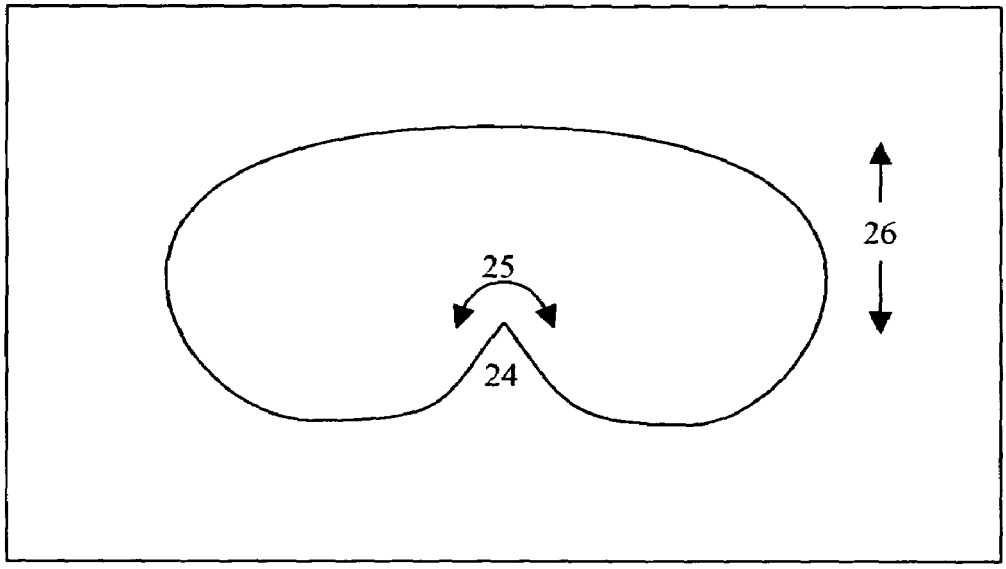
FIG. 4 is a plan view of an alternative embodiment of the present invention where the convex portion of the amoeba shaped opening is sufficiently small to form a point.

FIG. 4 is a plan view of an alternative embodiment of the soft toy holder for holding soft toys with a spongy texture, such as a sponge ball. The convex portion of the opening is sufficiently small so as to define pointy shape 25 for tab 24. Dimension 26 between the point of the tab and the opposite edge of the opening is smaller then the diameter of the sponge ball to be held. Dimension 26 secures the ball when it is inserted.

Figure 5:
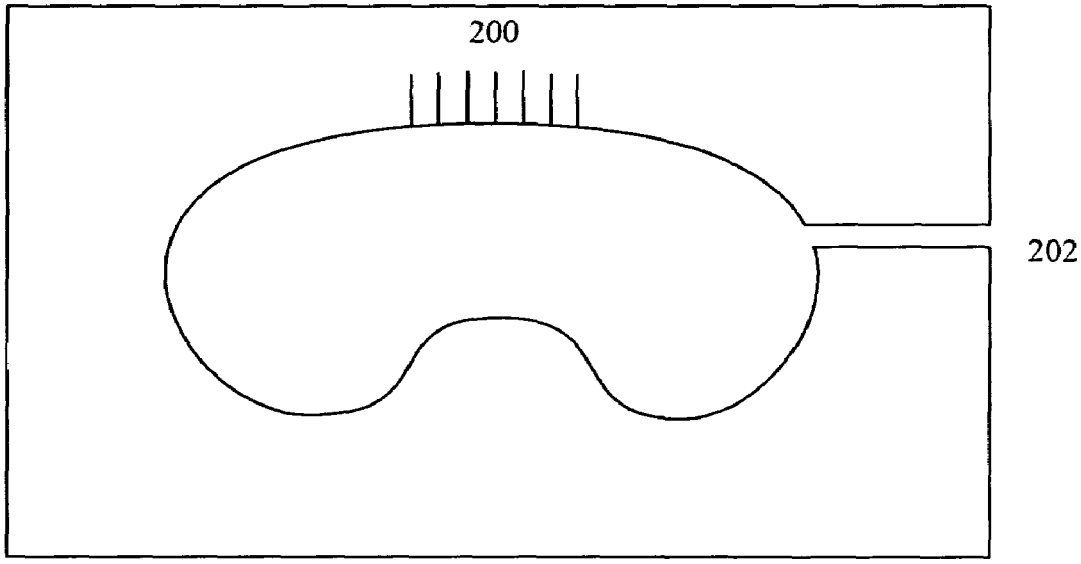
FIG. 5 is a plan view an alternative embodiment of the present invention where the amoeba shaped opening is further modified to include slits.

FIG. 5 is a plan view of an alternative embodiment of the present invention which provides additional flex to the sheet of material. Slits 200 are provided to allow extra flex at the edge of the opening. Gap 202 is provided to allow flexibility in the holder along the length of the opening.

Figure 6:
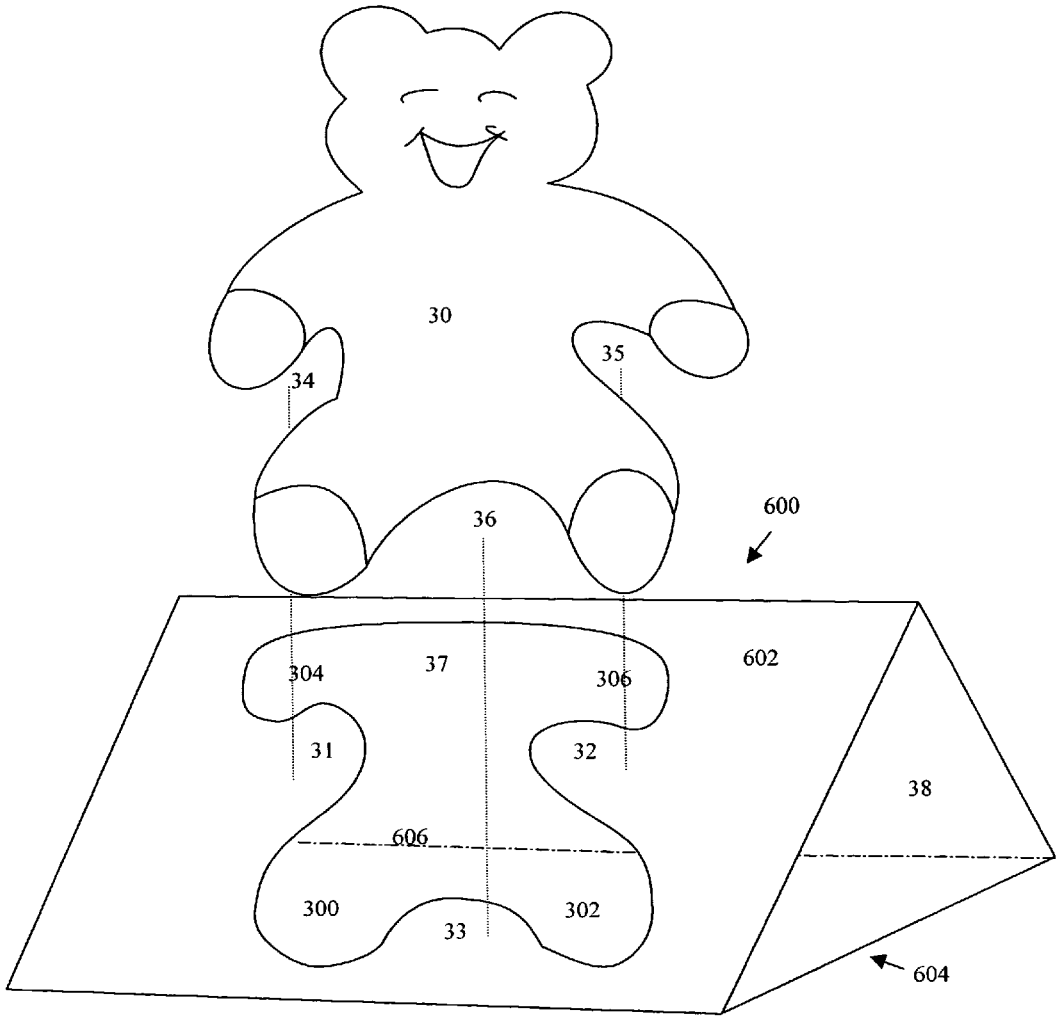
FIG. 6 is a perspective view of an alternative embodiment of the present invention where the amoeba shaped opening comprises three convex portions.

FIG. 6 is a perspective view of alternative embodiment of the soft toy holder 600 where three convex portions of the opening define three tabs, 31, 32 and 33. This embodiment is well suited for holding and displaying teddy bears and other similar soft toys. The tabs correspond to arm pits 34, 35 and crotch 36 of teddy bear 30. This correspondence is indicated by the vertical dotted lines. Five scoops, 300, 302, 304, 306 and 37 correspond to the legs, arms and back of the teddy bear respectively.

Sheet 602 is folded into triangular cross section 38 such that the portion of the sheet comprising the opening is at an angle with respect to horizontal surface 604. Dot-dash line 606 indicates the rear fold of the triangular cross section. The line is partially visible through the opening.

The sheet may be formed into the desired cross section by known means, such as folding or injection molding.

The angle of the sheet and shape of the opening cooperate to hold a soft toy such that it is displayed in a friendly, inviting sitting position with most of the bear visible and accessible.

Figure 7:
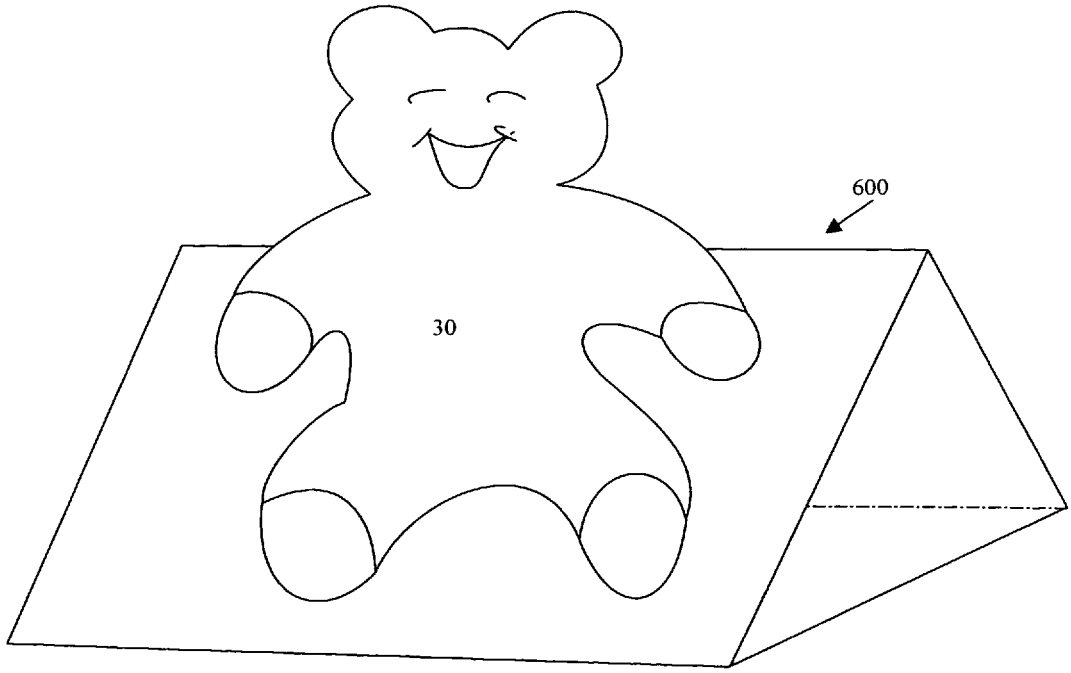
FIG. 7 is a perspective view of an additional alternative embodiment of the present invention where the invention comprises the combination of the soft toy holder and a teddy bear.

FIG. 7 is a perspective view of an additional alternative embodiment of the invention where teddy bear 30 and soft toy holder 600 are combined to form an item with particular retail appeal and personal use appeal. Most of the bear is visible and accessible for touching or viewing. The stand is self-supporting. The bear can be removed by pulling on an outwardly visible portion of it such as its head, ear, arms or legs. The bear can be reinserted by placing its bottom end near the opening and pushing in. The stiffness of the holder and the shape of the opening combine to make the holder self-aligning to the bear as it is pushed in. The holder can be oriented in any direction with respect to gravity and the bear will remain in it. The holder can be permanently mounted on a wall or on a swing arm near a bed.

Figure 8:
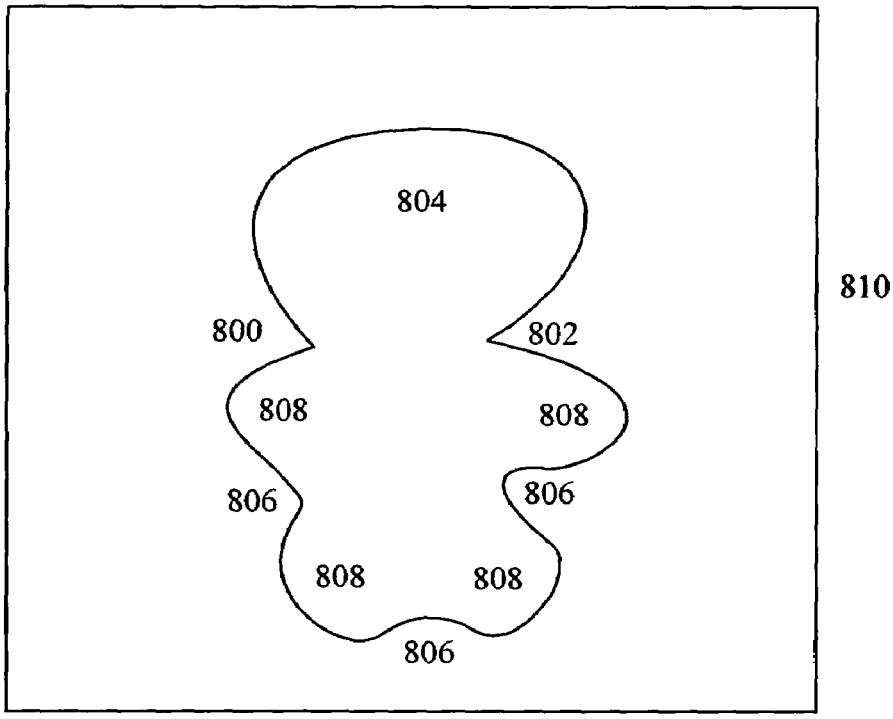
FIG. 8 is a front view of an alternative embodiment of the present invention where the amoeba shaped opening has provision for the head of a soft toy.

FIG. 8 is a front view of an additional alternative embodiment that is well suited for a sheet that is vertical or near vertical. Tabs 800 and 802 are provided to correspond to the neck of a soft toy. Scoop 804 corresponds to the head of the soft toy. Scoop 804 is substantially larger than the head such that the head may assume an apparently comfortable position when the soft toy is inserted.

The opening further comprises tabs 806 and scoops 808 which serve to hold the soft toy securely.

Figure 9:
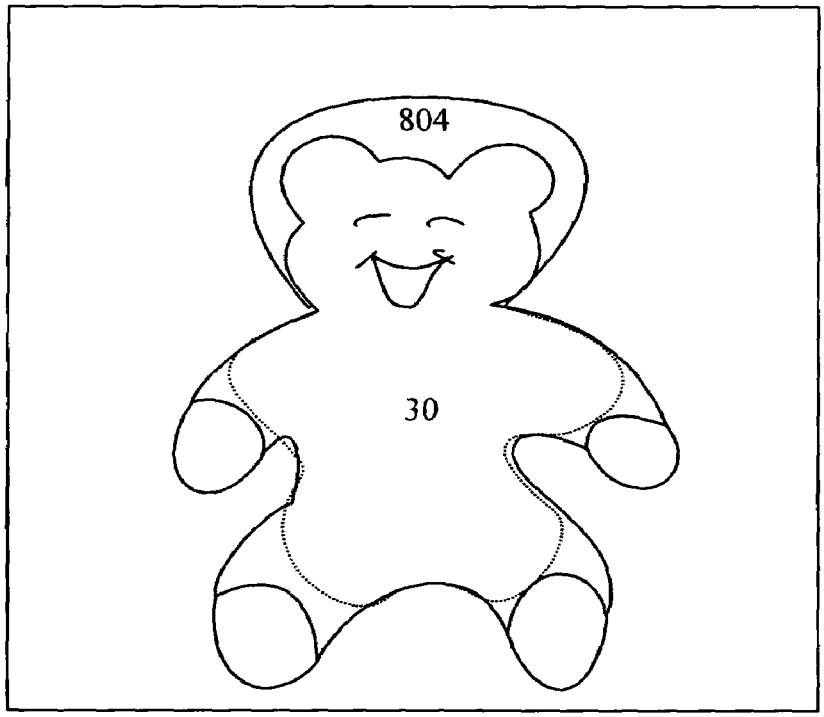
FIG. 9 is a front view of an additional alternative embodiment of the present invention where a soft toy is combined with a soft toy holder wherein the amoeba shaped opening has provision for the head of the soft toy.

FIG. 9 is a front view of an additional alternative embodiment that is the combination of the soft toy holder illustrated in FIG. 8 and soft toy 30. The dotted line corresponds to the tabs and scoops that securely hold the soft toy. Scoop 804 allows free movement of the head of the soft toy. This embodiment is suitable for retail display.

Figure 10:
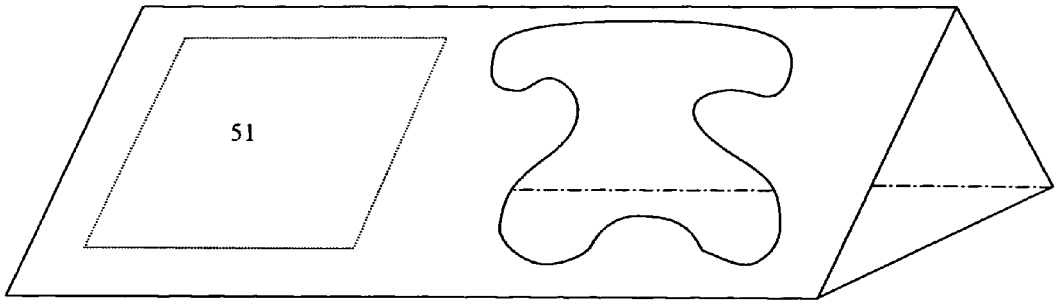
FIG. 10 is a perspective view of an additional alternative embodiment of the present invention where the sheet of material is folded into a triangular shape, and where the sheet of material comprises an area for displaying a message.

FIG. 10 is a perspective view of an additional alternative embodiment of the invention where sufficient additional space 51 is provided on the sheet to display a message or other graphic. This embodiment is well suited for use as a combination name-tag display and gift holder. This combination is suitable for a wedding reception or party where the soft toy serves as a party favor and the message area serves as a means to display a seating assignment. The combination can also be used as a premium or corporate gift where, for example, a company logo is displayed in the additional space. The combination may also serve as a greeting card. The combination may be wrapped or placed in a larger container for gift giving.

Figure 11:
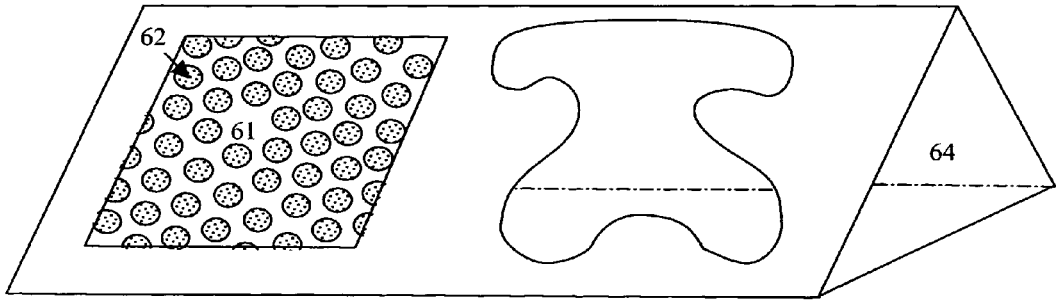
FIG. 11 is a perspective view of an additional alternative embodiment of the present invention where the triangular shape of the sheet of material provides a space to store additional items, such as candy, and where a window is provided to display the additional items.

FIG. 11 is a perspective view of an additional alternative embodiment of the invention where the space defined by triangular cross section 64 of the sheet of material serves to hold candy 62 or other items and where window 61 is provided in the sheet of material to reveal said other candy or other items. This embodiment is well suited for adding giftability to otherwise common items. A soft toy combined with another item or items in an attractive stand has more giftability than either item alone.

Figure 12:
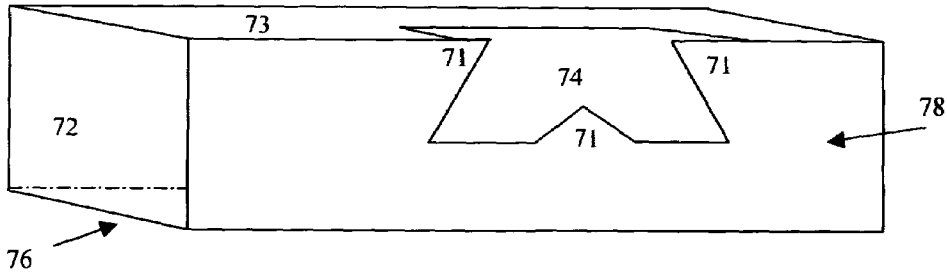
FIG. 12 is a perspective view of an additional alternative embodiment of the present invention where tabs defined by the amoeba shaped opening have a pointy shape.

FIG. 12 is a perspective view another embodiment of the invention where the sheet defines rectangular cross section 72, where tabs 71 in opening 74 are pointed, and where fold 73 in sheet 78 intersects opening 74. The rectangular cross section of the folded sheet is well suited to applications where the holder is to be folded flat for shipping. The pointed tabs are well suited for holding spongy soft toys. Fold 73 modifies opening 74 such that the center of gravity of a soft toy inserted in the opening is over the bottom 76 of the holder. This reduces the tendency of the combined toy holder and soft toy to tip over. A camera, set of video tapes or other item may be stored in the square cross section. The copackaging of the camera and soft toy increase the value of both to the consumer, particularly as a gift.

Figure 13:
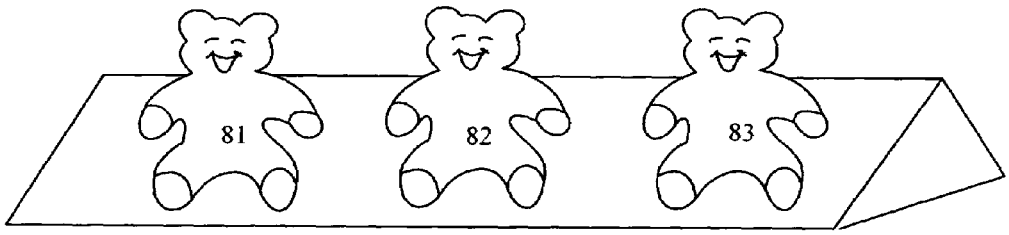
FIG. 13 is a perspective view of an additional alternative embodiment of the present invention where multiple amoeba shaped openings are provided to hold multiple toys in a horizontal orientation.

FIG. 13 is a perspective view of an additional alternative embodiment where multiple soft toys, 81, 82 and 83 are displayed horizontally. This embodiment is well suited for displaying soft toys on a shelf. The toys are maintained in an orderly manner. Missing toys are immediately apparent. This embodiment is well suited for the personal display of a set of collectable soft toys. A set of soft toys may be collectible, for example, when each soft toy of a set is similar to the others in that set in some respects but differs from the others in other respects. The toys may be similar in that they are all the same size and shape. They may be different in that each has a unique costume, color or accessory. The unfilled openings for each soft toy in the set will motivate an owner of the holder to purchase all of the toys in the set to fill all of the openings.

Figure 14:
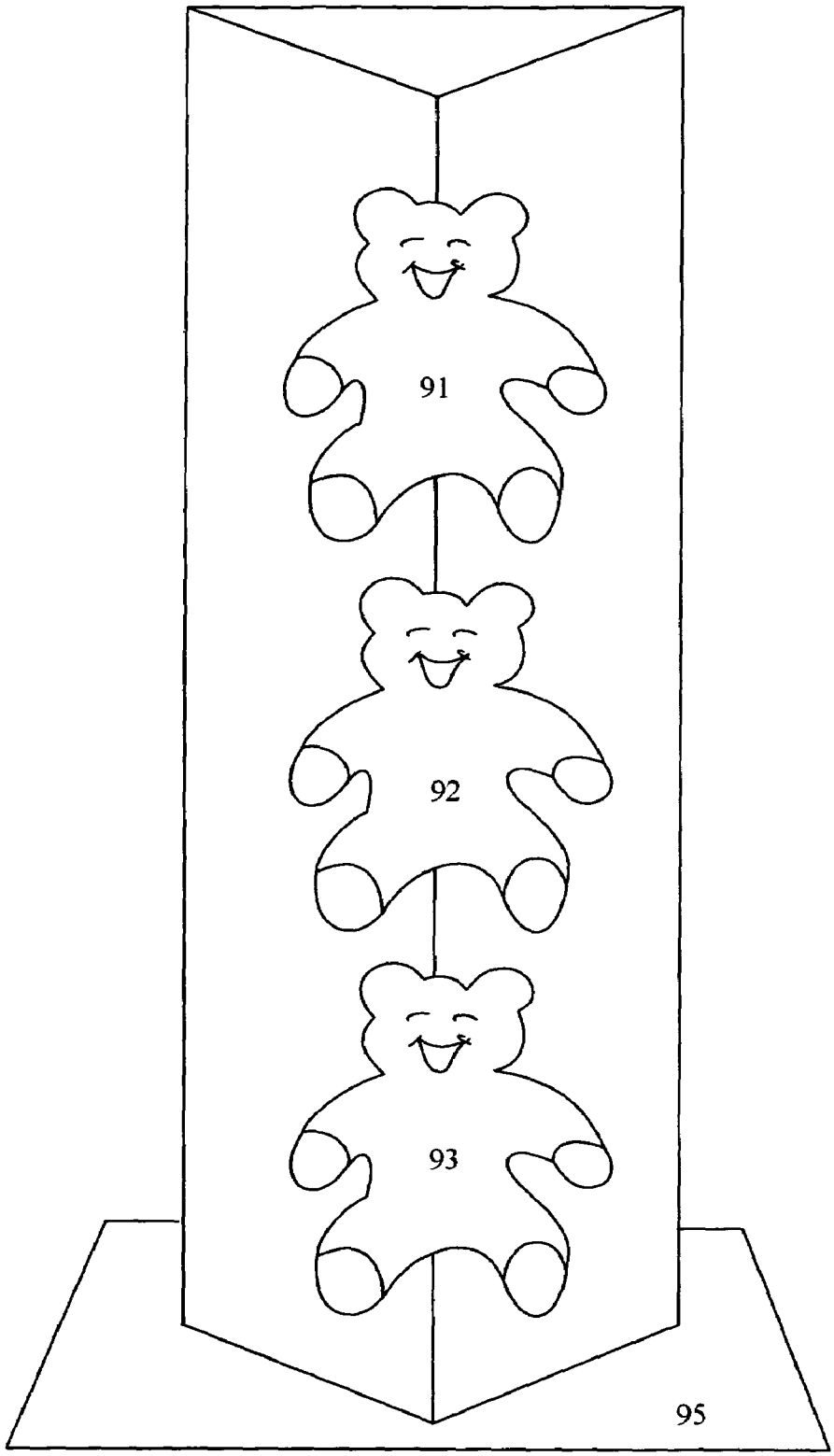
FIG. 14 is a perspective view of an additional alternative embodiment of the present invention where multiple amoeba shaped openings are provided to hold multiple toys in a vertical orientation.

FIG. 14 is a perspective view of an additional alternative embodiment where multiple soft toys 91, 92, and 93 are displayed vertically. A sheet is folded in a triangular cross section and the triangular cross section is oriented vertically. A fold passes through a plurality of amoeba shaped openings. The amoeba shaped openings may be equally shaped and equally spaced or may have different shapes, sizes and spacing. Soft toys are placed within the openings. This embodiment is well suited for displaying multiple soft toys for sale near a cash register where counter space is limited. The triangular cross section makes the display self-supporting. Additional bottom support 95 may also be provided to stabilize the holder. The toy holder may also be mounted on a wall. The toy holder may be secured to a ceiling.

Figure 15:
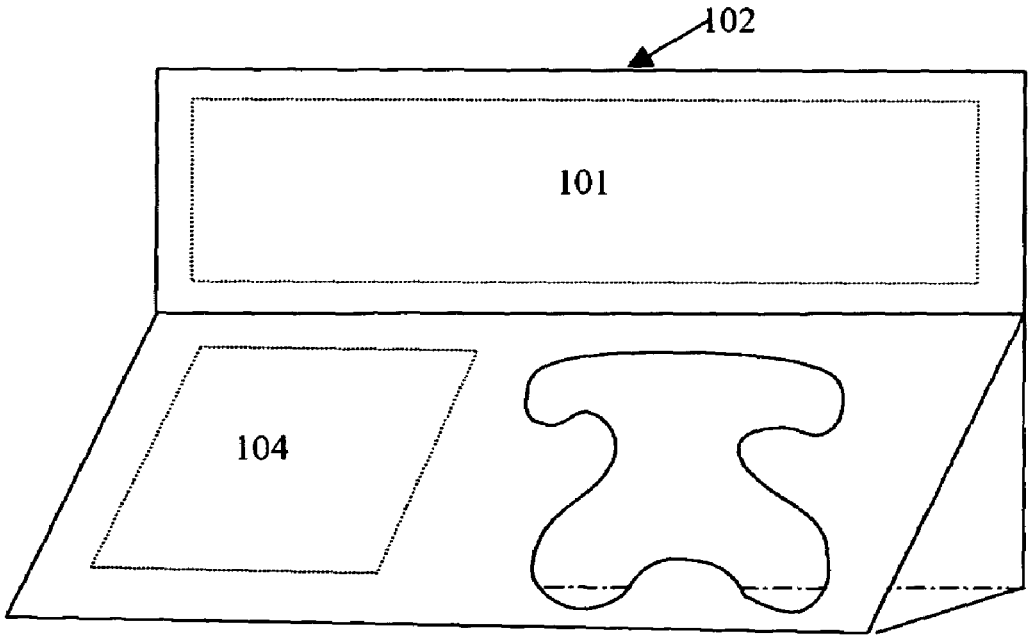
FIG. 15 is a perspective view of an additional alternative embodiment of the present invention where the sheet of material extends vertically to provide a large area to display a message or other graphic.

FIG. 15 is a perspective view of an additional alternative embodiment where the sheet of material is folded into a triangular shape with an additional portion of the sheet extending above the rear wall of the triangle to form message area 102. This configuration is well suited for a retail display where additional information or a marketing graphic is provided to the consumer. The message area may be detachable to provide coupons or other promotional items.

An alternative message area comprises two sheets of material sandwiched together with removable center portion 101. The message area serves as a frame for a photograph or other insertable graphic when the center portion is removed. The center portion may serve as a coupon.

Additional message area 104 can be provided adjacent to the opening.

Figure 16:
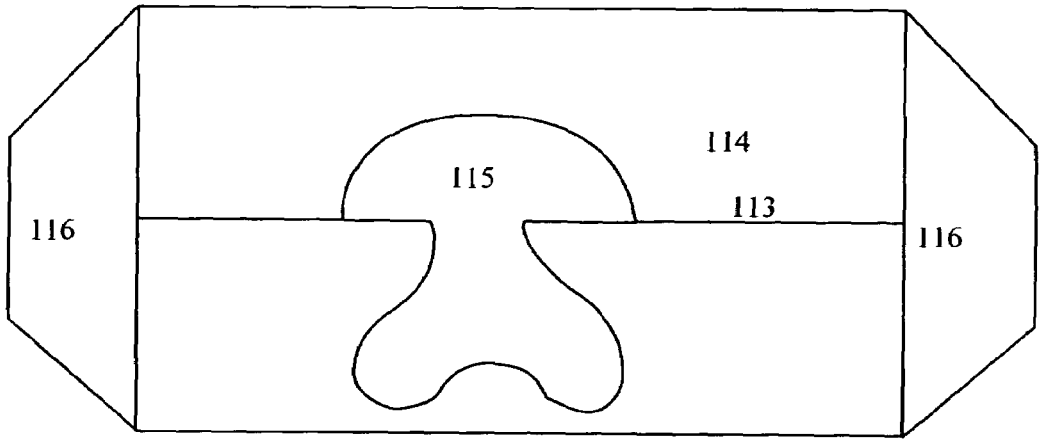
FIG. 16 is a plan view of an additional alternative embodiment of the present invention where the sheet of material has been first folded and assembled into a square cross section and then folded flat and where the present invention comprises autobottoms.

FIG. 16 is a plan view of an additional alternative embodiment where sheet of material 114 is folded into a square cross section and then flattened for ease of shipping. Fold line 113 intersects amoeba shaped opening 115. This embodiment further comprises autobottoms 116.

Figure 17:
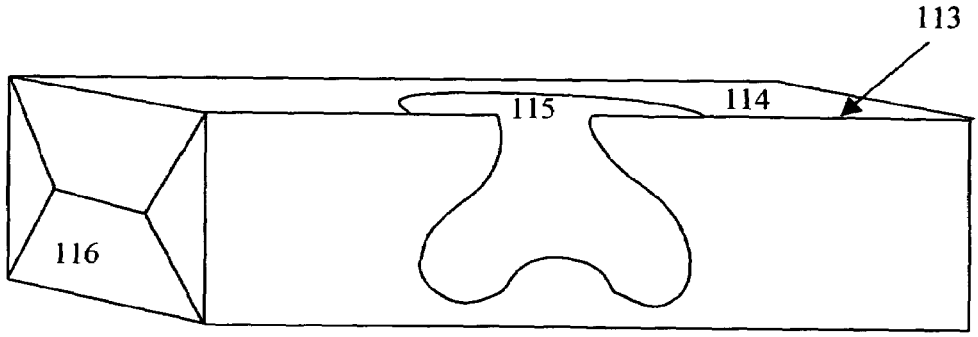
FIG. 17 is a perspective view of the same embodiment as FIG. 16 where the sheet of material has been opened back into its square cross section.

FIG. 17 is a perspective view of the embodiment of FIG. 16 where the sheet of material has been folded from its flattened state to its square cross section shape. Autobottoms 116 become the side-walls of the toy holder.

Figure 18:
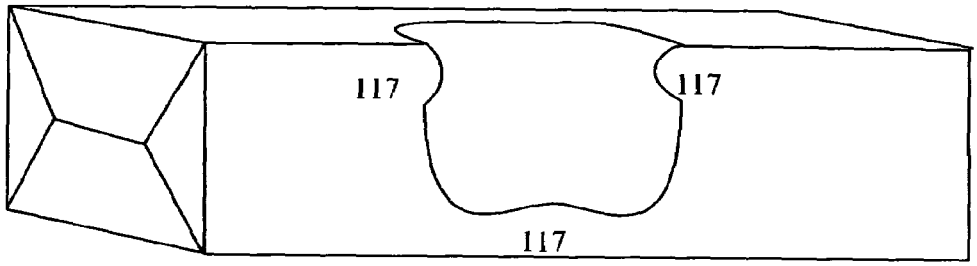
FIG. 18 is a perspective view of the same embodiment as FIG. 17 except that the size of the tabs has been reduced.

FIG. 18 is a perspective view of an additional alternative embodiment where tabs 117 have been reduced to a small size relative to the overall size of the opening. The minimum tab size is such that a soft toy will not readily slip out of the opening when the soft toy holder is moved or tilted.

Figure 19:
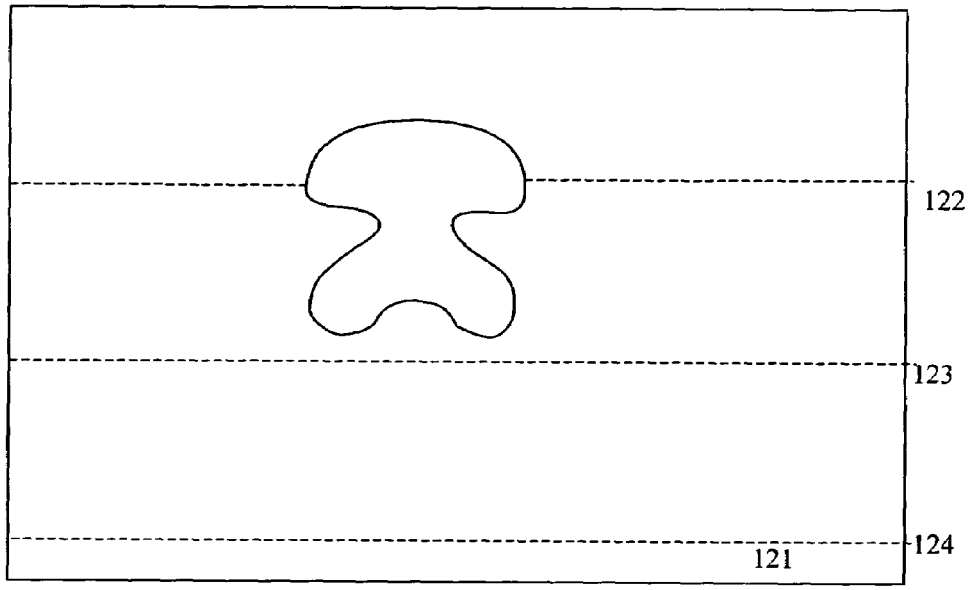
FIG. 19 is a plan view of an additional alternative embodiment of the present invention where the sheet is to be folded such that a triangular shape is to be formed and where one of the folds will pass through the opening and where a tab is provided to attach one end of the sheet to the other.

FIG. 19 is a plan view of a sheet of material of an additional alternative embodiment prior to assembly. The position of three folds is indicated by dashed lines 122, 123 and 124. Flap 121 is indicated that will form an attachment means between one edge of the sheet of material and the other edge when said sheet is folded along the dashed lines.

Figure 20:
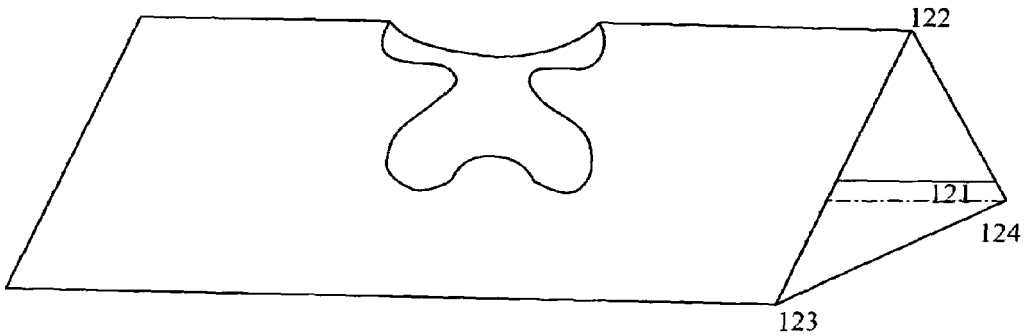
FIG. 20 is a perspective view of the same embodiment as FIG. 19 where the sheet has been folded and assembled into a triangular cross section.

FIG. 20 is a perspective view of the embodiment illustrated in FIG. 19. The sheet has been folded along dashed lines 122, 123 and 124 and flap 121 has been attached to the opposite edge of the sheet. A preferred means of attachment is by gluing.

Figure 21:
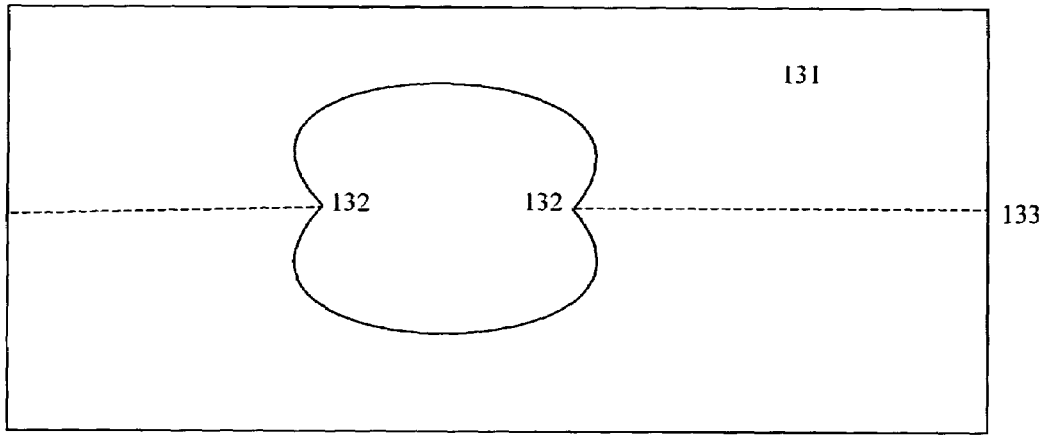
FIG. 21 is a plan view of an additional alternative embodiment of the present invention that is suitable for holding a soft toy without appendages such as a sponge ball and where the sheet of material is sufficiently stiff to hold a V shape after it has been folded.

FIG. 21 is a plan view of a sheet of material of an additional alternative embodiment prior to assembly. Sheet of material 131 is sufficiently stiff that it will retain a shape when bent. The material of the sheet is preferably a metal, such as aluminum, or a plastic, such as polycarbonate or a stiff paper. Tabs 132 in the amoeba shaped opening are pointed. Fold line 133 passes through the tips of tabs 132. This embodiment is well suited for holding and displaying a soft toy, such as a sponge ball, with a spongy texture. In a preferred embodiment, the pointed tips of tabs 132 are rounded slightly so that they do not cut the soft toy.

Figure 22:
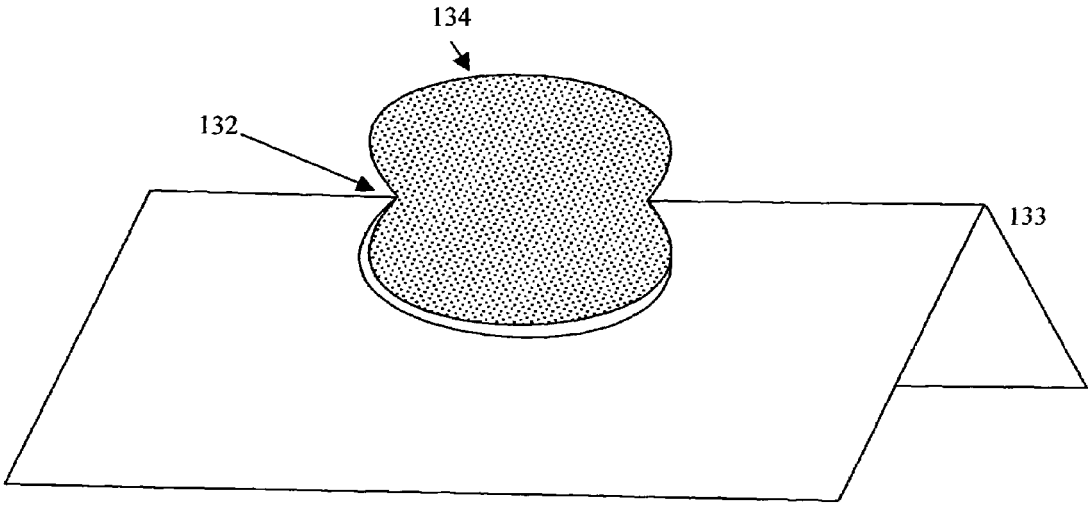
FIG. 22 is a perspective view of the same embodiment as FIG. 21 where the sheet has been folded into a V shape and where a soft toy has been added to the assembly.

FIG. 22 is a perspective view of the embodiment of FIG. 21 after the sheet has been bent in combination with a sponge ball 134. For this and other embodiments, the sheet may be curved.

Figure 23:
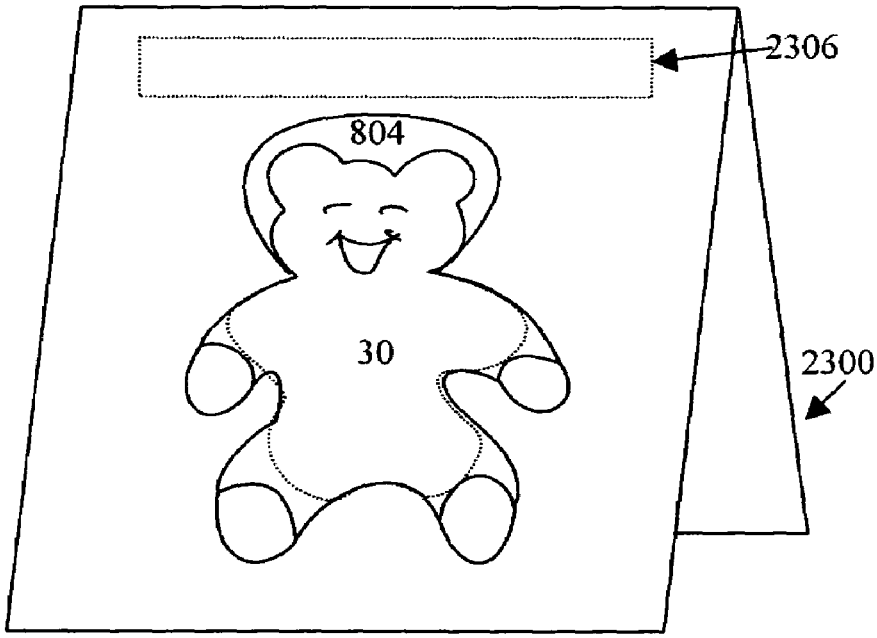
FIG. 23 is a perspective view of an additional alternative embodiment that serves as a greeting card.

FIG. 23 is a perspective view of an additional alternative embodiment that serves as a greeting card. A single sheet is folded into a V shape and stands upright using rear flap 2300. The amoeba shape opening comprises head scoop 804. Soft toy 30 is inserted into the opening. Message area 2306 is provided above the soft toy. A preferred message for a romantic greeting is "I love you!" or other non-English greeting of similar meaning.

Figure 24:
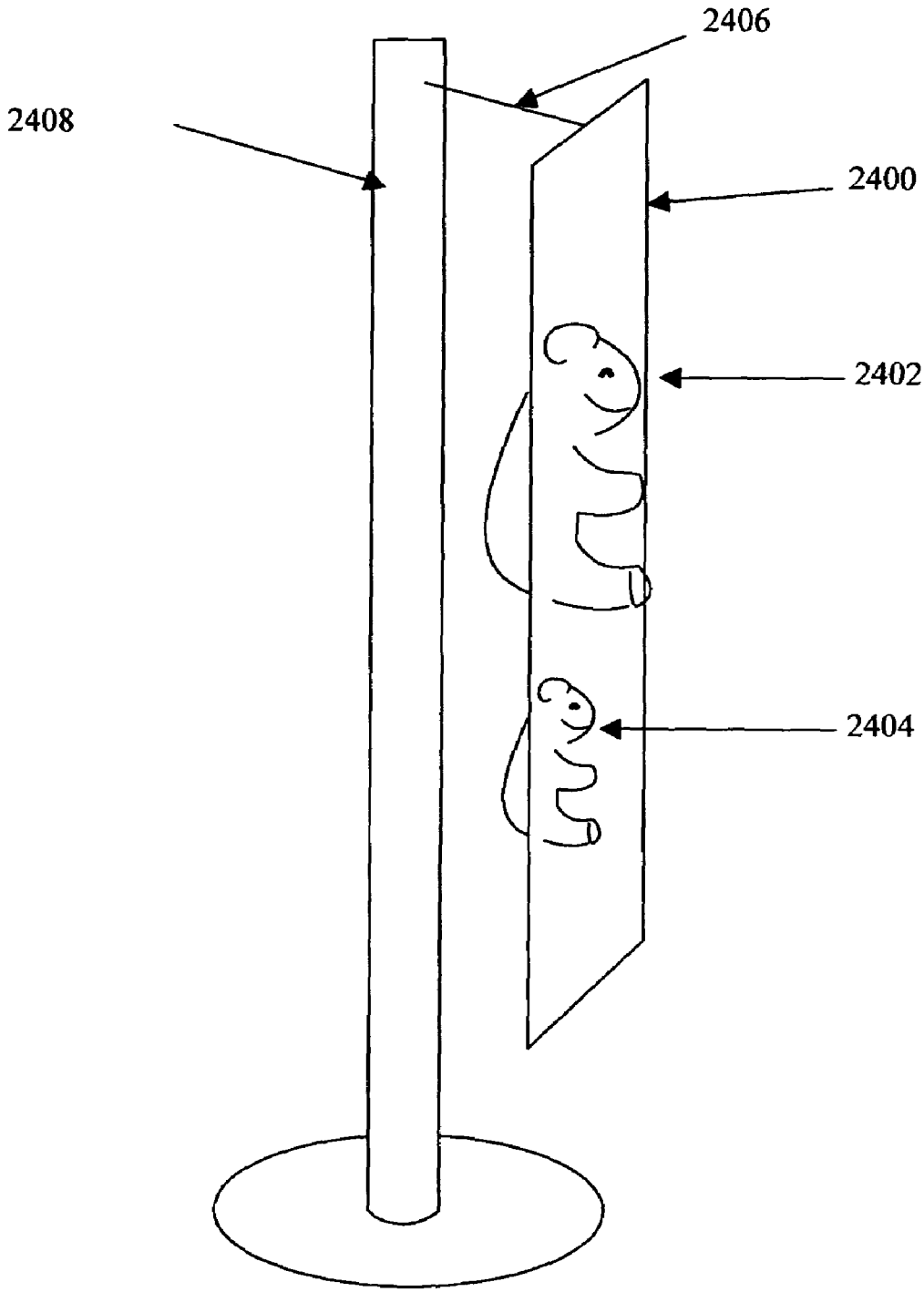
FIG. 24 is a perspective view of an additional alternative embodiment that is suitable for retail display of soft toys.

FIG. 24 is a perspective view of an additional alternative embodiment that serves as a retail display. Single sheet 2400 has multiple amoeba shaped openings of differing sizes. Multiple soft toys 2402 and 2404 of various sizes are inserted into the corresponding openings. The front and back of the toys are readily visible. The single sheet is suspended from vertical pole 2408 by wire 2406 or other suitable means. Conventional means are used to keep the vertical pole upright.

Figure 25:
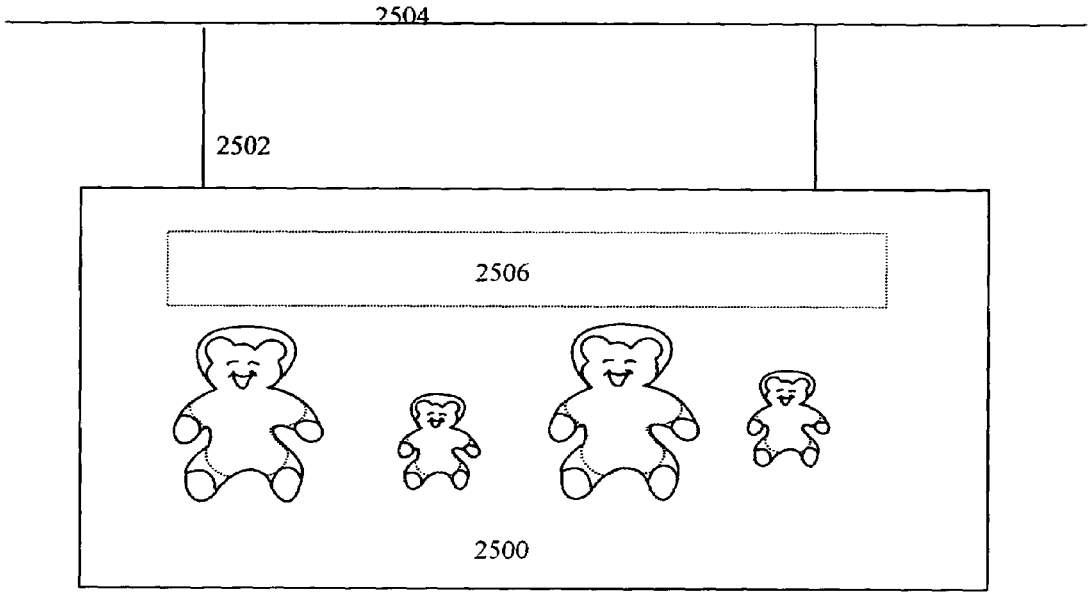
FIG. 25 is a perspective view of an additional alternative embodiment that is suitable for use as a banner.

FIG. 25 is a front view of an additional alternative embodiment that serves as a banner. Single sheet 2500 has multiple various sized openings with multiple various sizes soft toys inserted therein. Message area 2506 is provided. A preferred message where the banner is used to announce a region of a store used to sell teddy bears is "Welcome to Teddyland!" or other non-English equivalent appropriate to the location of the store.

Single sheet 2500 is suspended from ceiling 2504 by wires 2502 or other suitable means. The height and size of the soft toy holder is such that it can be readily seen from a distance in the store. The single sheet is preferably stiff enough that it retains its shape under its own weight and that of the soft toys.

Figure 26:
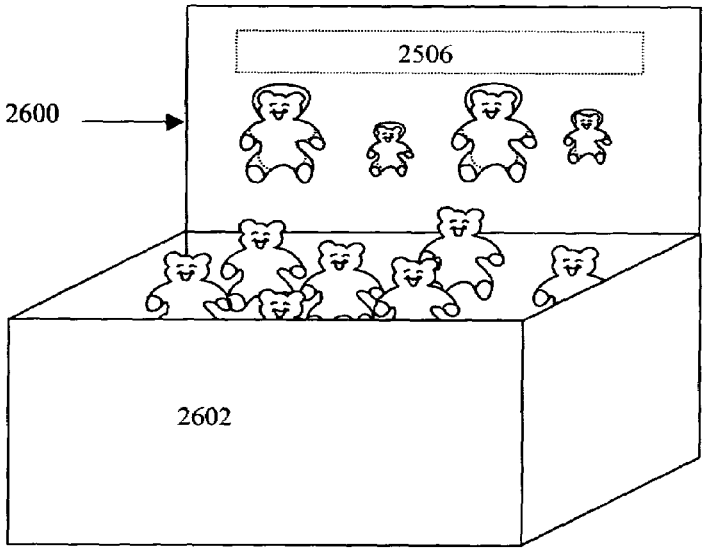
FIG. 26 is a perspective view of an additional alternative embodiment that serves as both a retail display unit and a storage container for loose soft toys.

FIG. 26 is a perspective view of an additional alternative embodiment which is suitable to display soft toys in both and orderly and a random manner. Box 2602 serves to hold a group of soft toys in a random manner. Sheet 2600 serves to hold soft toys in an orderly manner. Message area 2506 is preferably provided.

Figure 27:
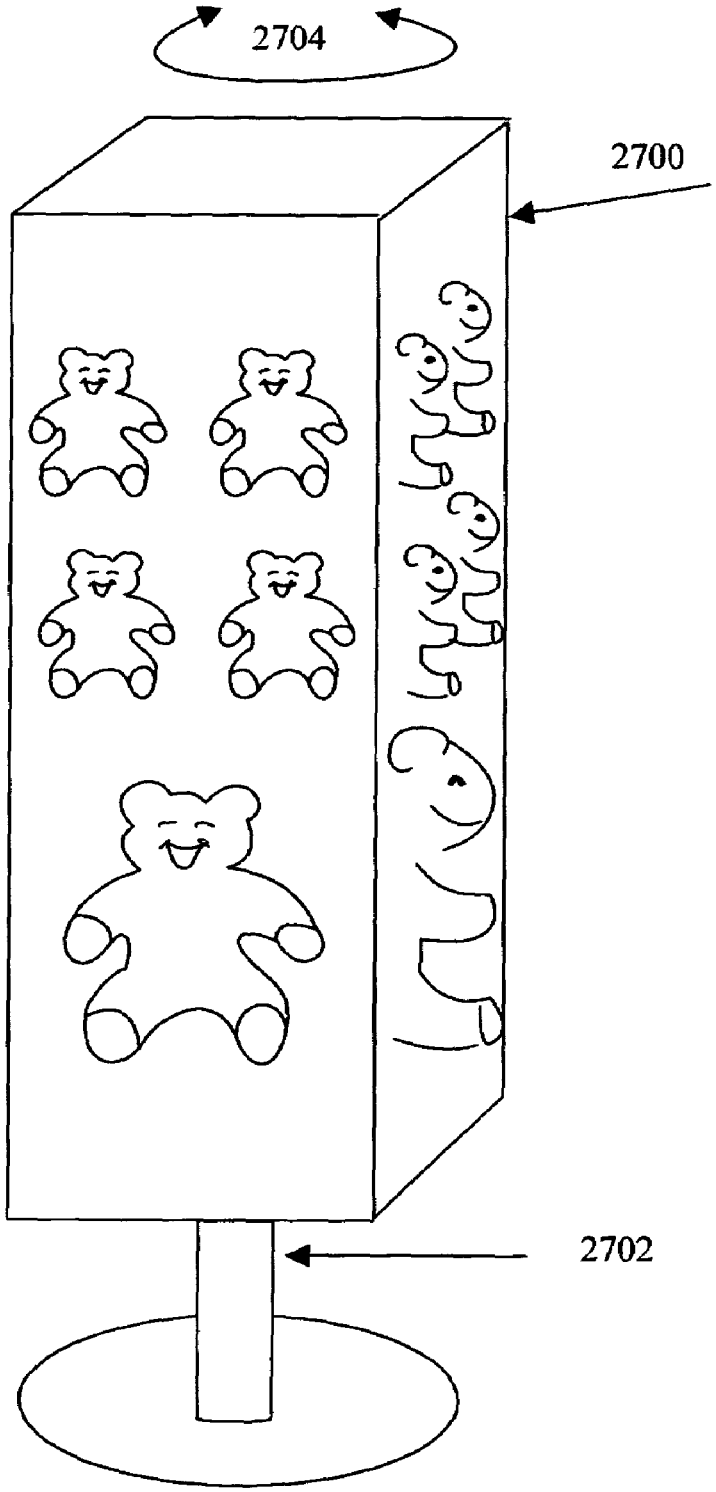
FIG. 27 is a perspective view of an additional alternative embodiment that is suitable for retail display and rotates about a vertical axis.

FIG. 27 is a perspective view of an additional alternative embodiment that is suitable for retail display of soft toys. Sheet 2700 is folded into a square cross section. Other cross sections such as triangular, hexagonal and circular are also suitable. Amoeba shaped openings are provided in the different faces of the sheet. Soft toys are inserted in the openings. The sheet is mounted in vertical pole 2702 and is free to rotate about the pole. Curved arrow 2704 indicates the rotation of the display. The display may be rotated by a potential customer to view the soft toys on each side. It may also be motorized to rotate continuously.

Figure 28:
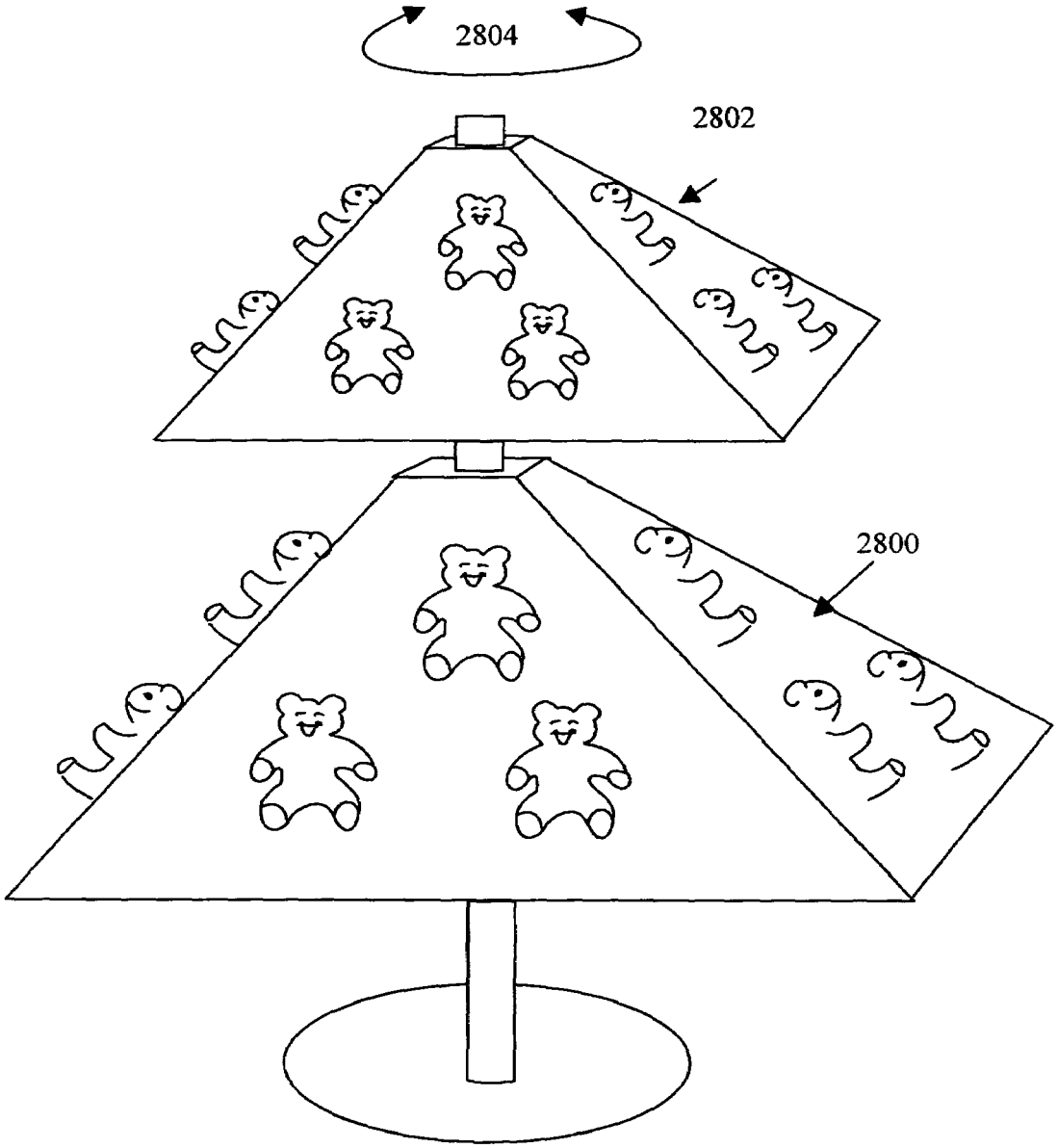
FIG. 28 is a perspective view of an additional alternative embodiment that is suitable for retail display and provides two sub-units that can be rotated independently.

FIG. 28 is a perspective view of an additional alternative embodiment that is suitable for retail display of soft toys at multiple heights. Sheets 2800 and 2802 are formed into frusto-pyramidal shapes. Amoeba shaped openings are provided on the faces of the pyramids. Soft toys are inserted into the openings. Two or more pyramids are mounted on a vertical pole. Each pyramid is free to rotate as indicated by curved arrow 2804. The at least two separate pyramids allow two consumers, such as a parent and child, to independently choose a preferred face to look at.

Having thus described the invention with particular reference to the embodiments thereof, it will be obvious that various changes and modifications can be made therein without departing from the spirit and scope of the present invention as defined in the appended claims.

I claim:

1. A combined soft toy and soft toy holder for display of the combination where the soft toy holder comprises a sheet of material with an opening therein wherein:

a. said opening is such that said sheet of material forms at least a first, second and third tab when said sheet of material is in a flat configuration;

b. said first and second tabs are directed inwardly of said opening;

c. said first and second tabs are approximately opposite each other;

d. at least one of said tabs has an area that is greater than or equal to one percent of the area of said opening when said sheet is in a flat configuration;

and wherein:

e. said sheet of material is folded such that said holder has a square or rectangular cross section comprising a first, second, third and fourth side;

f. said opening straddles said first side of said holder and said second side of said holder, said first side and said second side being adjacent to each other;

g. at least a portion of said first and second tabs and the entirety of said third tab reside on said first side of said holder;

and wherein:

h. said soft toy comprises two arms, two legs and a head;

i. said soft toy sits in said opening such that the center of mass of said soft toy is over the bottom of said holder when said holder is oriented such that said soft toy sits in an upright position with said arms, head and legs being visible;

j. said first and said second tabs correspond to the arm pits of said soft toy and are dimensioned such that said soft toy may be inserted or removed from said opening by a person without requiring undue force; and k. said first and said second tabs are dimensioned to press against the sides of the soft toy such that said soft toy will be held in said opening when said holder is oriented such that said soft toy is upside down.

2. The combination of claim 1 wherein said third tab corresponds to the crotch of said soft toy such that said soft toy sits with its legs apart in a substantially uncompressed position.

3. The combination of claim 1 wherein the shape of said opening corresponds to a surface outline of said soft toy and wherein said soft toy must be deformed and compressed inward in order to be placed into or removed from said opening.

* * * * *